US010124239B2

(12) United States Patent
Contant et al.

(10) Patent No.: US 10,124,239 B2
(45) Date of Patent: Nov. 13, 2018

(54) GLOVE FOR A HOCKEY OR LACROSSE PLAYER

(71) Applicant: BAUER HOCKEY CORP., St-Jerome (CA)

(72) Inventors: Mathieu Contant, Verdun (CA); Marco Beauregard, Morin Heights (CA); Alexandre Leblanc, Montreal (CA)

(73) Assignee: BAUER HOCKEY, LLC, Exeter, NH (US)

( * ) Notice: Subject to any disclaimer, the term of this patent is extended or adjusted under 35 U.S.C. 154(b) by 773 days.

(21) Appl. No.: 13/968,825

(22) Filed: Aug. 16, 2013

(65) Prior Publication Data

US 2015/0047087 A1 Feb. 19, 2015

(51) Int. Cl.

| | |
|---|---|
| ***A41D 13/08*** | (2006.01) |
| ***A63B 71/14*** | (2006.01) |
| *A63B 102/24* | (2015.01) |
| *A63B 102/14* | (2015.01) |

(52) U.S. Cl.

CPC ..... *A63B 71/143* (2013.01); *A63B 2102/14* (2015.10); *A63B 2102/24* (2015.10)

(58) Field of Classification Search

CPC ..... A63B 2102/24; A63B 71/143; A63B 2102/14

USPC ..... 2/161.1

See application file for complete search history.

(56) References Cited

U.S. PATENT DOCUMENTS

| | | | | | |
|---|---|---|---|---|---|
| 1,841,193 | A | * | 1/1932 | Lidston | A63B 71/143 2/16 |
| 3,605,117 | A | * | 9/1971 | Latina | A63B 71/143 2/16 |
| 3,626,515 | A | * | 12/1971 | Murray | A63B 71/143 2/16 |
| 4,484,359 | A | * | 11/1984 | Tirinen | A41D 19/01523 2/161.1 |
| 4,497,073 | A | * | 2/1985 | Deutsch | A63B 71/143 2/16 |
| 4,815,147 | A | * | 3/1989 | Gazzano | A63B 71/143 2/161.1 |
| 4,930,162 | A | * | 6/1990 | Cote | A63B 71/143 2/16 |

(Continued)

OTHER PUBLICATIONS

Examiner's report dated Mar. 16, 2016 in connection with Canadian Patent Application 2,824,328, 2 pages.

*Primary Examiner* — Richale Quinn
*Assistant Examiner* — Anne Kozak

(57) ABSTRACT

A hockey or lacrosse glove comprising a dorsal sheet extending longitudinally from a proximal end proximate the distal end of the cuff to a distal end proximate the proximal end of each finger gusset and extending transversally from a medial end to a lateral end, the dorsal sheet having a maximal length measured between its proximal and distal ends and a maximal width measured between its medial and lateral ends; and a dorsal protector covering the dorsal sheet. The dorsal protector comprises a single pocket mounted to the dorsal sheet and occupying at least three-quarters of the maximal length of the dorsal sheet and at least three-quarters of the maximal width of the dorsal sheet and a padding element contained in the single pocket, the padding element comprising a flexion zone.

24 Claims, 16 Drawing Sheets

(56) References Cited

U.S. PATENT DOCUMENTS 5,168,576 A * 12/1992 Krent ..... A41D 13/0156 2/16
5,329,639 A * 7/1994 Aoki ..... A63B 71/143 2/16
5,488,739 A * 2/1996 Cardinal ..... A63B 71/143 2/16
5,511,243 A * 4/1996 Hall ..... A63B 71/143 2/16
5,530,967 A 7/1996 Cielo
5,787,506 A * 8/1998 Wilder ..... A63B 71/143 2/159
5,946,720 A * 9/1999 Sauriol ..... A63B 71/143 2/16
5,983,396 A * 11/1999 Morrow ..... A63B 71/143 2/16
6,122,769 A * 9/2000 Wilder ..... A63B 71/143 2/159
6,233,744 B1 * 5/2001 McDuff ..... A63B 71/143 2/16
6,256,792 B1 7/2001 MacDonald
6,543,057 B2 * 4/2003 Beland ..... A63B 71/143 2/16
6,550,069 B1 * 4/2003 Morrow ..... A63B 71/141 2/16
6,584,615 B1 * 7/2003 Wilder ..... A41D 19/01588 2/159
6,611,962 B2 9/2003 Redwood et al.
6,990,690 B2 * 1/2006 Gait ..... A63B 71/148 2/161.1
7,406,719 B2 * 8/2008 Aoki ..... A41D 19/01523 2/16
7,802,315 B2 * 9/2010 Contant ..... A63B 71/143 2/16
8,132,269 B1 3/2012 Ibon et al.
8,141,175 B2 * 3/2012 Winningham ... A41D 19/01523 2/161.1
D751,769 S * 3/2016 McPhail ..... D29/116.3
2002/0040494 A1 * 4/2002 Kleinert ..... A41D 19/015 2/161.1
2003/0163862 A1 * 9/2003 Hoffman ..... A63B 71/143 2/161.1
2004/0111785 A1 * 6/2004 Sande ..... A63B 71/143 2/161.1
2004/0261155 A1 * 12/2004 Agathos ..... A63B 71/143 2/161.1
2005/0091721 A1 * 5/2005 Best ..... A63B 71/143 2/16
2005/0114984 A1 * 6/2005 Morrow ..... A63B 71/143 2/161.1
2005/0251893 A1 * 11/2005 Hayden ..... A41D 19/01523 2/161.1
2006/0130210 A1 * 6/2006 Gait ..... A41D 19/01523 2/160
2007/0245451 A1 * 10/2007 Desjardins ..... A41D 19/01523 2/159
2008/0034469 A1 * 2/2008 Beland ..... A63B 71/143 2/161.1
2008/0034471 A1 * 2/2008 Beland ..... A63B 71/143 2/161.6
2008/0120753 A1 * 5/2008 Desjardins ..... A41D 13/088 2/16
2008/0244799 A1 * 10/2008 Winningham ... A41D 19/01523 2/16
2008/0313785 A1 * 12/2008 Rudd ..... A63B 71/143 2/16
2009/0019613 A1 * 1/2009 Carcaterra ..... A63B 71/143 2/16
2009/0044306 A1 * 2/2009 Lamson ..... A41D 19/01523 2/16
2009/0300821 A1 * 12/2009 Winningham ... A41D 19/01588 2/161.1
2011/0067165 A1 * 3/2011 Fream ..... A63B 71/143 2/161.1
2011/0126342 A1 * 6/2011 Bautista ..... A63B 71/143 2/161.1
2012/0054937 A1 * 3/2012 Robaire ..... A63B 71/148 2/16
2012/0131714 A1 * 5/2012 Copeland ..... A63B 71/143 2/16
2012/0131715 A1 * 5/2012 Copeland ..... A63B 71/143 2/16
2012/0131716 A1 * 5/2012 Copeland ..... A63B 71/143 2/20
2012/0131725 A1 * 5/2012 Copeland ..... A63B 71/143 2/161.1
2012/0297514 A1 * 11/2012 Aoki ..... A63B 71/143 2/20
2013/0269076 A1 * 10/2013 Arnone ..... A41D 19/01523 2/20
2014/0026280 A1 * 1/2014 Clark ..... A41D 19/01523 2/16
2014/0026282 A1 * 1/2014 Rusakov ..... A63B 71/143 2/20
2014/0143924 A1 * 5/2014 Rusakov ..... A63B 71/143 2/16
2014/0143925 A1 * 5/2014 Chorne ..... A63B 71/143 2/20
2014/0143926 A1 * 5/2014 Brown ..... A63B 71/143 2/20
2014/0201880 A1 * 7/2014 Binge ..... A63B 71/141 2/20
2014/0331376 A1 * 11/2014 Chorne ..... A41D 13/082 2/16
2015/0047087 A1 * 2/2015 Contant ..... A63B 71/143 2/16
2015/0047088 A1 * 2/2015 Contant ..... A63B 71/143 2/16
2015/0047089 A1 * 2/2015 Chambers ..... A63B 71/143 2/20
2015/0106990 A1 * 4/2015 Gait ..... A63B 71/143 2/20
2015/0265904 A1 * 9/2015 Lemieux ..... A63B 71/143 2/161.1
2015/0305416 A1 * 10/2015 Chorne ..... A63B 71/143 2/16

* cited by examiner

GLOVE FOR A HOCKEY OR LACROSSE PLAYER

FIELD OF THE INVENTION

The present invention relates to a glove for a hockey or lacrosse player.

BACKGROUND OF THE INVENTION

Hockey and lacrosse players typically wear protective gloves during game play in order to prevent injuries to their hands. As such, much attention is given to the design and construction of the gloves in order to provide an appropriate level of protection and comfort.

In a traditional glove construction, the dorsal portion comprises a plurality of distinct dorsal protectors (padding elements enclosed in separate pockets) for protecting the dorsal side of the player's hand and that are separated by a plurality of gaps, spaces, grooves, channels or flexion zones. The dorsal portion often includes distinct dorsal protectors of different shapes which are stitched beside one another to cover the entirety of the dorsal side of the player's hand. Each of the padding elements is contained within a respective pocket. The dorsal protectors are thus slightly spaced apart in order to provide flexibility to the dorsal portion of the glove. By virtue of the plurality of distinct dorsal protectors and plurality of flexion zones, the traditional glove therefore permits a level of flexibility while also providing protection.

However, it is understood that providing a plurality of dorsal protectors involves a plurality of components and manufacturing steps, because for each dorsal protector, a pocket enclosing a padding element must be stitched to the dorsal sheet. As such, there is a need in the industry for a hockey or lacrosse glove which is less costly to manufacture while still providing a suitable level of protection and flexion to the player's hand. Thus, it is a feature to produce gloves that provide flexibility, comfort and protection and to produce gloves that reduce design and production costs, that are less complex in design, and that have fewer components and/or require less manufacturing steps.

SUMMARY OF THE INVENTION

The present invention provides a glove for protecting a hand of a hockey or lacrosse player, the player's hand having a wrist, a palm, a dorsal side with medial and lateral edges, four fingers and a thumb, each finger extending from a proximal articulation to a distal end, the hockey or lacrosse glove defining a longitudinal axis generally parallel to a longitudinal axis of the player's hand and comprising a hand receiving portion and a cuff for at least partially covering the wrist, the cuff extending longitudinally from a proximal end to a distal end, the hand receiving portion comprising: (a) a thumb sheath for protecting the thumb of the player's hand; (b) four finger sheaths for protecting the four fingers of the player's hand, each finger sheath having a finger gusset for receiving the finger and a finger protector covering the finger gusset, each finger gusset having a proximal end for covering the proximal articulation of the finger and a distal end for covering the distal end of the finger; (c) a palm sheet for covering the palm of the player's hand; (d) a dorsal sheet for covering the dorsal side of the player's hand when the glove is in use, the dorsal sheet extending longitudinally from a proximal end proximate the distal end of the cuff to a distal end proximate the proximal end of each finger gusset and extending transversally from a medial end proximate the medial edge of the dorsal side of the player's hand to a lateral end proximate the lateral edge of the dorsal side of the player's hand, the dorsal sheet having a maximal length measured between its proximal and distal ends and a maximal width measured between its medial and lateral ends; and (e) a dorsal protector covering the dorsal sheet, the dorsal protector comprising (i) a single pocket mounted to the dorsal sheet and occupying at least three-quarters of the maximal length of the dorsal sheet and at least three-quarters of the maximal width of the dorsal sheet and (ii) a padding element contained in the single pocket, the padding element comprising a flexion zone such that, in use, flexing of the player's hand imparts movement of the padding element of the dorsal protector.

Other aspects and features of the present invention will become apparent to the persons skilled in the art upon review of the following description of embodiments of the invention in conjunction with the accompanying figures.

BRIEF DESCRIPTION OF THE DRAWINGS

A detailed description of the embodiments of the present invention is provided herein below, by way of example only, with reference to the accompanying drawings, in which.

Figure 1A:
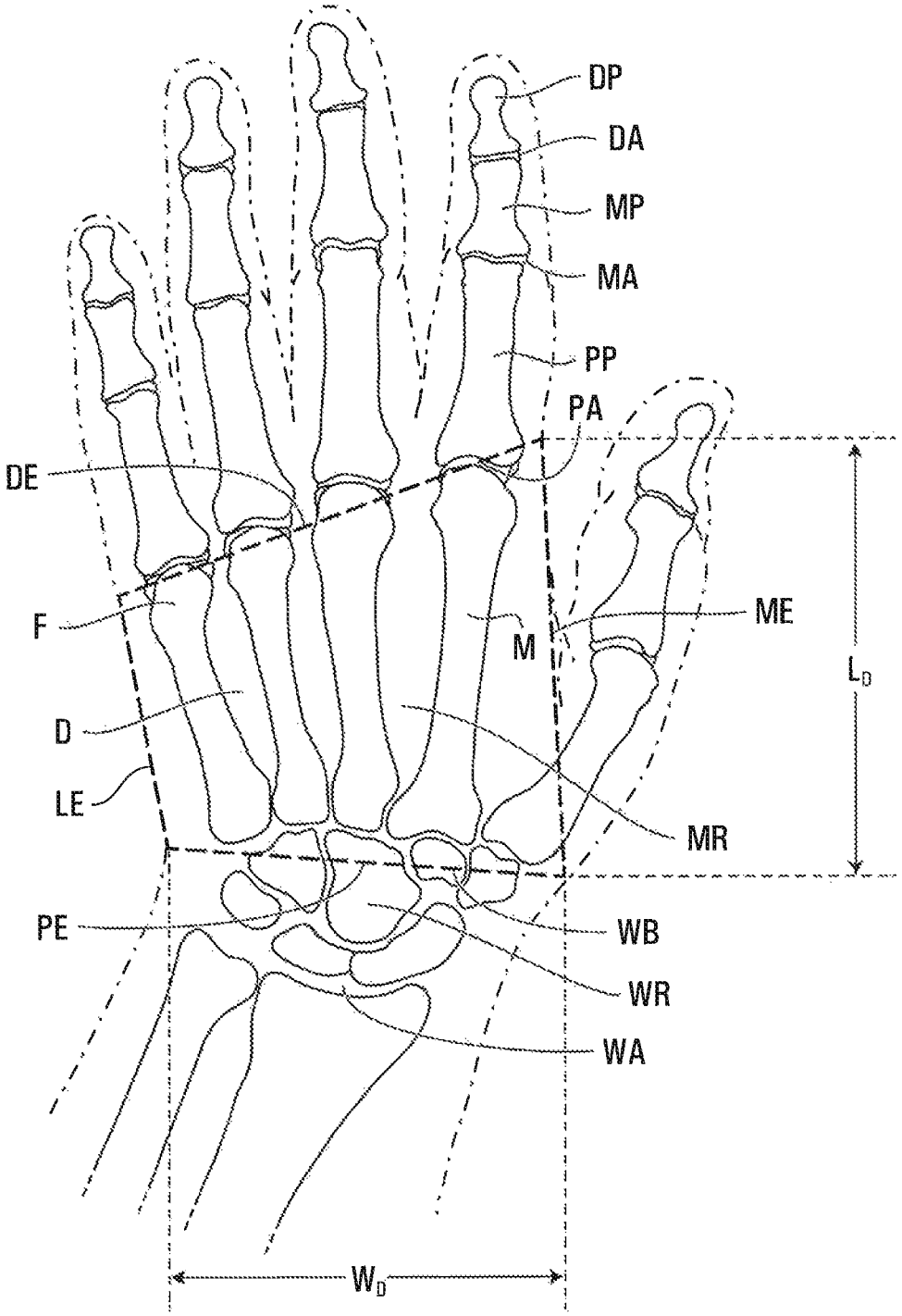
FIG. 1A is a top view of a human hand with the integument of the hand shown in broken lines and the bones shown in full lines.

In the drawings, the embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 1B:
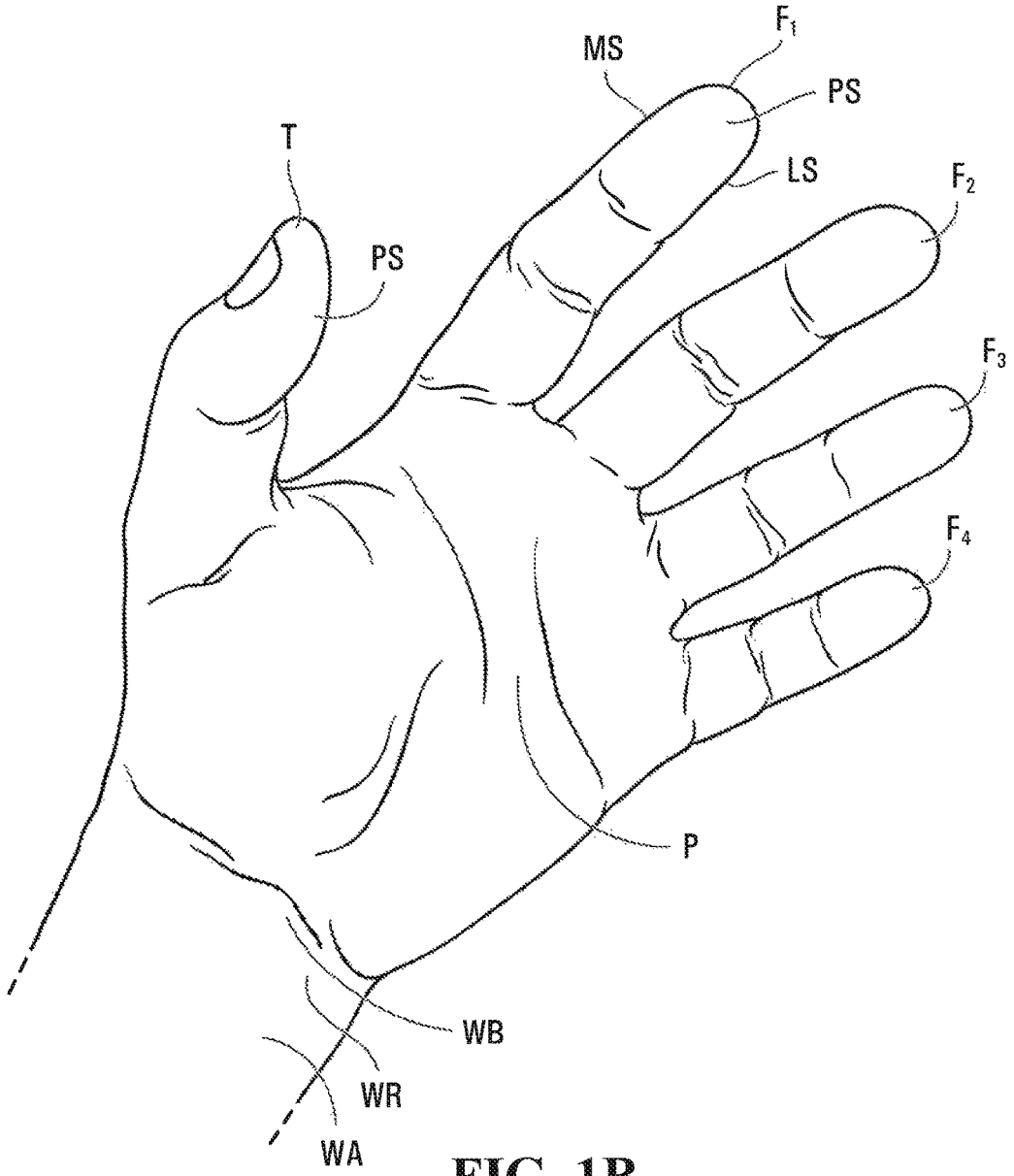
FIG. 1B is a bottom perspective view of a human hand.
Figure 1C:
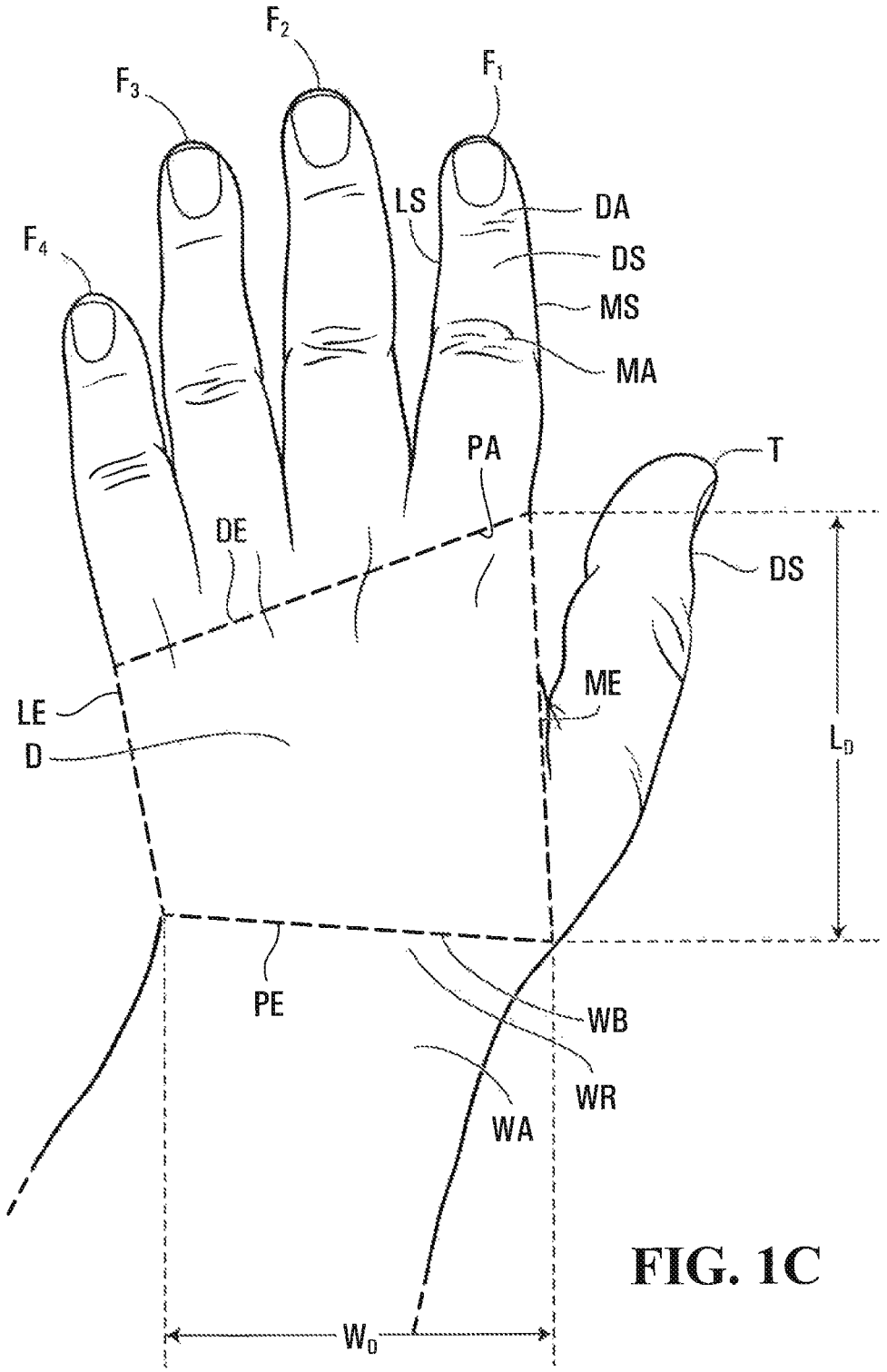
FIG. 1C is a top perspective view of the human hand of FIG. 1B.

As shown in FIGS. 1A, 1B and 1C, a human hand comprises a wrist WR, a palm P, a dorsal side D, four fingers (index finger $F_1$, middle finger $F_2$, ring finger $F_3$ and little finger $F_4$) and a thumb T. The wrist WR has a proximal edge WA and a distal edge WB.

Each finger has a palm surface PS, a dorsal surface DS, a lateral surface LS, a medial surface MS, a metacarpal M, a proximal articulation PA, a proximal phalanx PP, a middle articulation MA, a middle phalanx MP, a distal articulation DA and a distal phalanx DP.

The metacarpals M of the human hand define a metacarpal region MR having a medial edge ME, a lateral edge LE, a proximal edge PE and a distal edge DE. The thumb T also has a palm surface PS and a dorsal surface DS.

As best seen in FIGS. 1A and 1C, the dorsal side D of the hand may be generally seen as a trapezoid having a length $L_D$ from the distal edge WB of the wrist WR (or the proximal edge PE of the metacarpal region MR of the hand) to the proximal articulations PA of each finger F (or the distal edge DE of the metacarpal region MR of the hand) and a width $W_D$ from the lateral edge of the dorsal side D (i.e. the lateral edge LE of the metacarpal region MR) to the medial edge of the dorsal side D (i.e. the medial edge ME of the metacarpal region MR) (see the trapezoid shown in broken lines).

Figure 2:
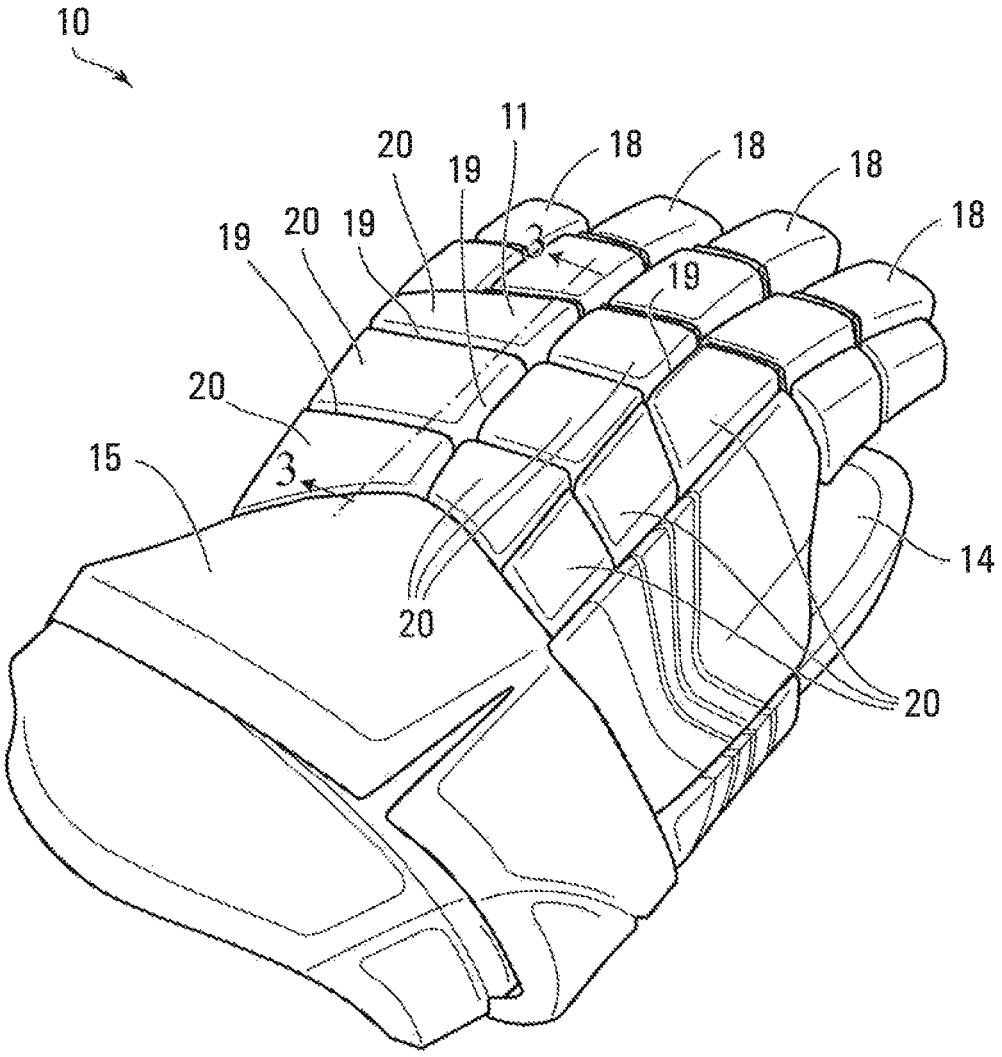
FIG. 2 (Prior Art)
FIG. 2 is a perspective view of a prior art glove for a hockey or lacrosse player.
Figure 3:
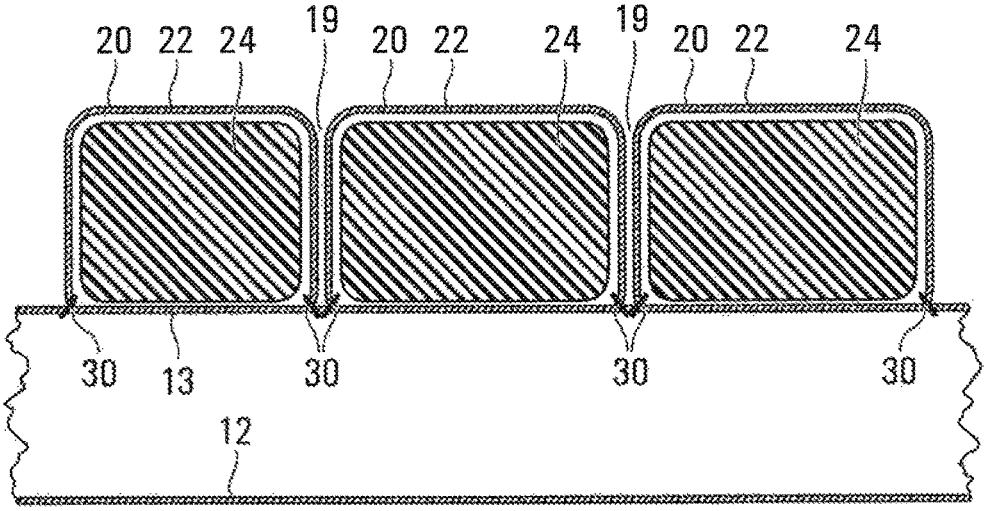
FIG. 3 (Prior Art)
FIG. 3 is an enlarged cross-sectional view taken along lines 3-3 of FIG. 2.

FIGS. 2 and 3 illustrate a prior art glove 10 for protecting a hand and a wrist of a hockey or lacrosse player. The glove 10 has a hand receiving portion 11 for covering the palm and dorsal side of the hand and a thumb sheath 14 for covering the thumb. The hand receiving portion 11 comprises a palm sheet 12 for facing the palm of the hand. The hand receiving portion 11 also comprises a dorsal sheet 13 for covering the dorsal side of the hand. Each of the palm and dorsal sheets 12, 13 are connected to respective palm and dorsal finger sheets for covering the palm and dorsal surfaces of the respective fingers. The hand receiving portion 11 also has finger sheaths 16 for protecting the player's fingers. Each finger sheath 16 includes a gusset 17 and at least one finger padding element 18 attached to the finger gusset 17 for protecting the fingers. The glove 10 also comprises a cuff 15 for covering the player's wrist.

The prior art glove 10 includes a plurality of dorsal protectors 20 which cooperatively cover the dorsal region of the glove and which generally overly the dorsal side of the player's hand. As best seen in FIG. 3, each of the dorsal protectors 20 includes a pocket 22 and a padding element 24. The pockets 22 are formed by stitching a layer of material to the dorsal sheet 13 (see stitches 30 in FIG. 3). The dorsal sheet 13 therefore acts as a base layer on which pockets 22 are attached. While only portion of the stitches 30 are shown in FIG. 3, it is understood that the stitches 30 surround the padding elements 24 to hold the padding elements 24 in place on the dorsal sheet 13.

In the prior art glove 10, the dorsal protectors 20 are spaced such as to provide a level of flexibility in both a longitudinal and a lateral direction of the glove 10. The dorsal protectors 20 are thus separated by gaps, spaces, grooves or channels 19 which act as flexion zones that allow flexion of the dorsal region of the glove 10 when the player's hand flexes. For example, as seen in FIG. 2, the dorsal region of the glove may have two longitudinal flexion zones 19 and two transversal flexion zones 19 for adding flexibility to the dorsal region and allowing some degree of flexion of the player's hand. Hence, the dorsal region of the prior art glove 10 has nine distinct dorsal protectors 20 made of nine pockets 22 enclosing nine padding elements 24 and these dorsal protectors 20 are separated by four gaps, spaces, grooves, channels or flexion zones 19.

As it is well known in the art, the flexibility of the prior art gloves along their dorsal portion is largely dependent on the presence of these gaps, spaces, grooves, channels or flexion zones between the distinct dorsal protectors and a prior art glove thus generally comprises at least three distinct dorsal protectors separated by two gaps, spaces, grooves, channels or flexion zones.

FIGS. 4 to 7 illustrate a glove 100 for protecting a hand of a hockey or lacrosse player and being constructed in accordance with a first embodiment of the invention.

The glove 100 has side protectors 101 for protecting the side portion of the player's index finger. The glove 100 also includes a lateral protective region 121 for protecting the lateral portion of the player's hand. In the embodiment shown, the lateral protective region 121 includes a number of protectors (such as lateral protectors 121A, 121B).

Figure 4:
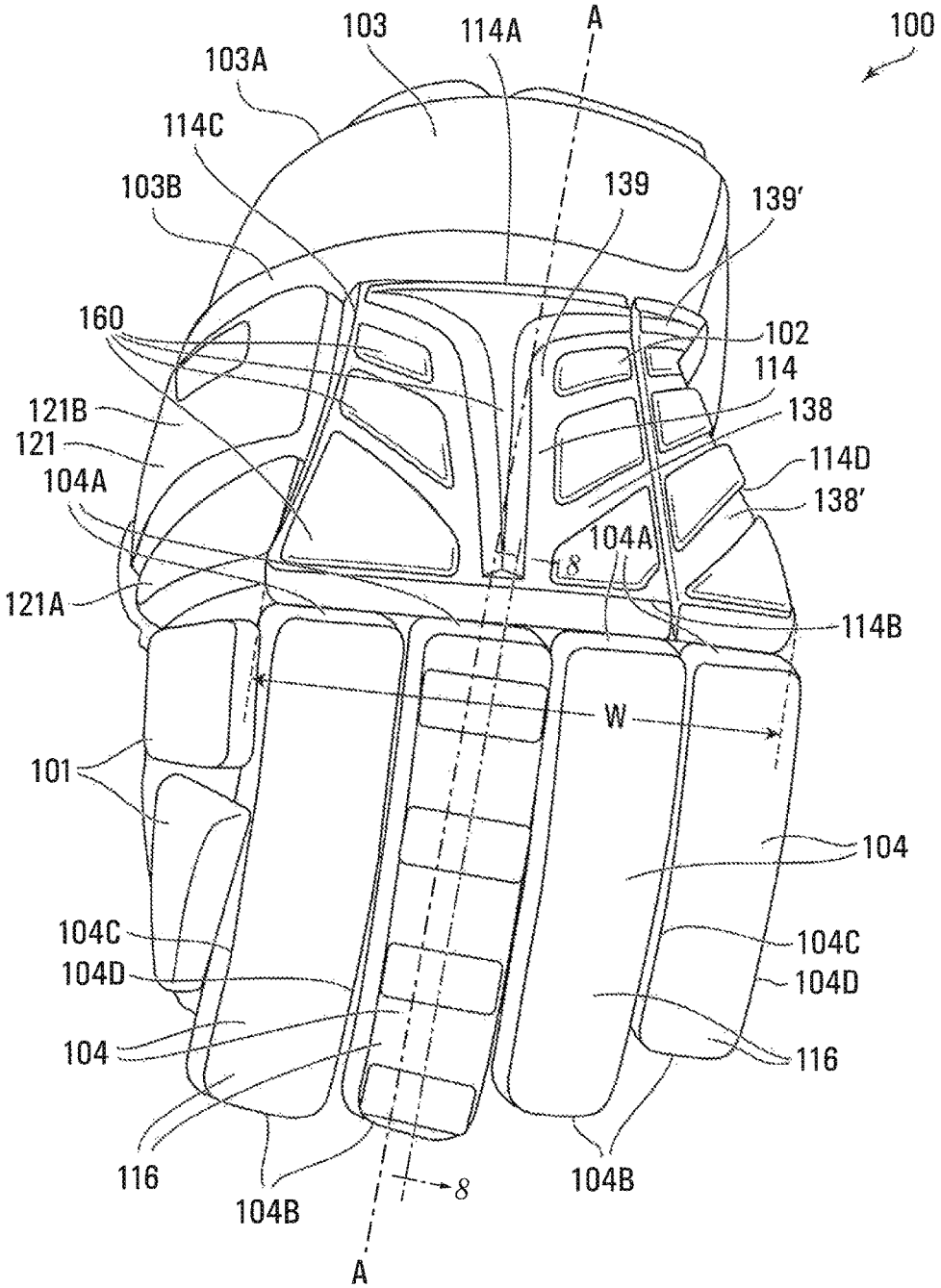
FIG. 4 is a perspective view of a hockey or lacrosse glove constructed in accordance with a first embodiment of the invention.
Figure 5:
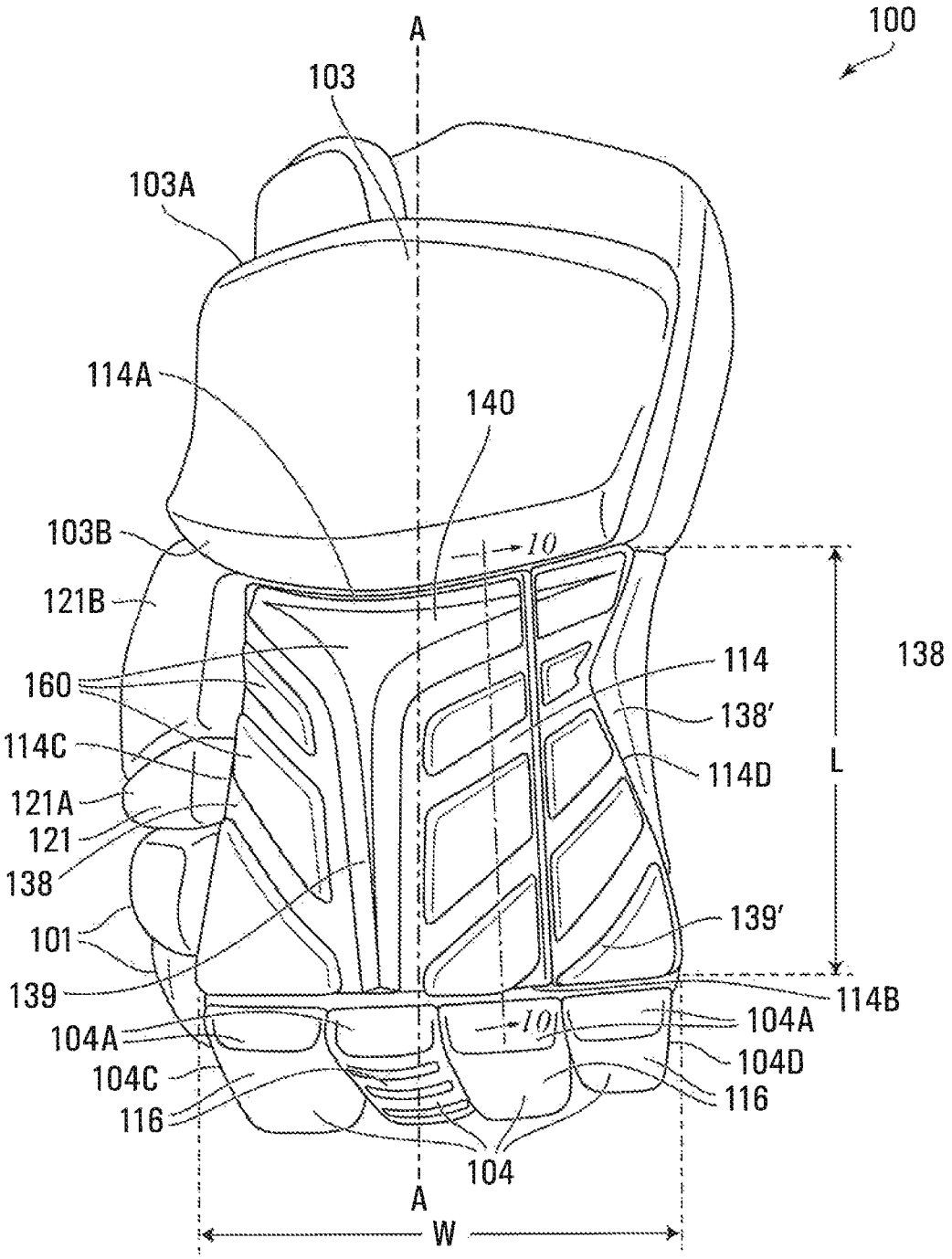
FIG. 5 is a top view of the glove of FIG. 4.
Figure 6:
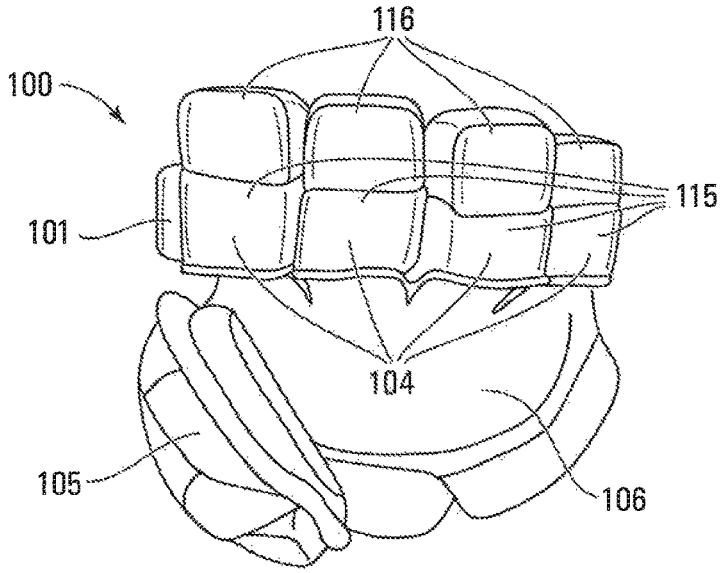
FIG. 6 is a front view of the glove of FIG. 4 showing the finger sheaths in an extended (or open) position.
Figure 7:
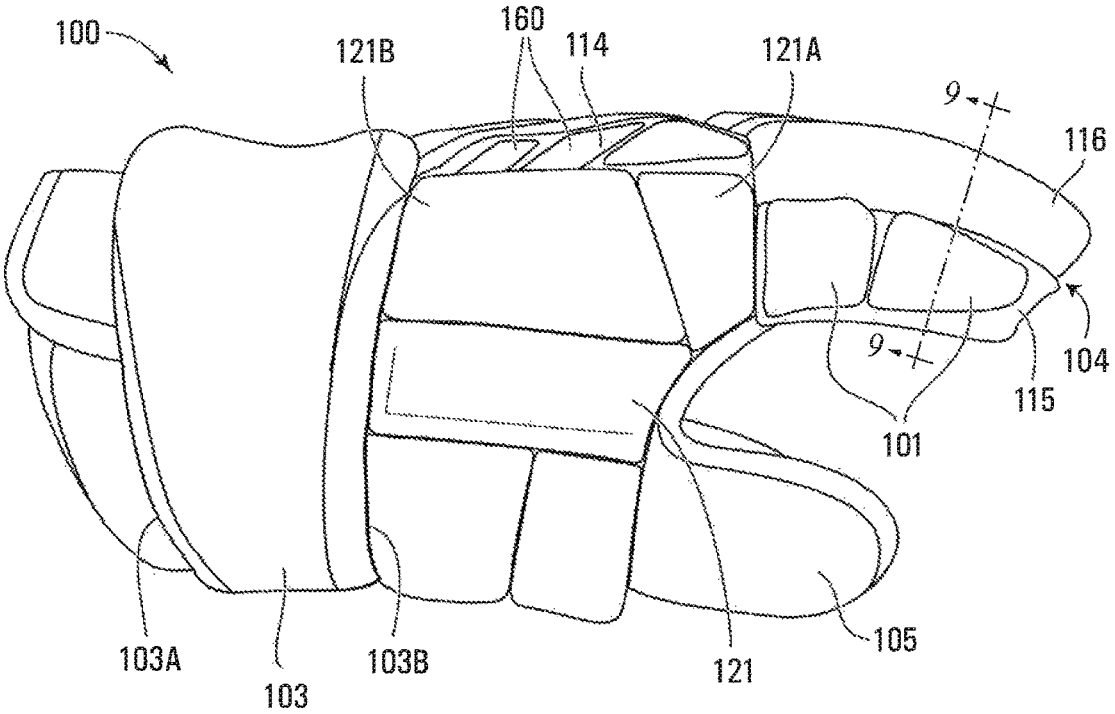
FIG. 7 is a side view of the glove of FIG. 6.

The glove 100 has a hand covering portion 102 including a dorsal portion 114 for covering the dorsal side of the player's hand. As best seen in FIGS. 4 and 5, the dorsal portion 114 extends longitudinally from a proximal dorsal end 114A to a distal dorsal end 114B and extends transversally from a medial dorsal edge 114C to a lateral dorsal edge 114D. The hand covering portion 102 also includes a thumb sheath 105 for covering the player's thumb. The glove 100 further comprises a cuff 103, which extends along a sufficient length for protecting the player's wrist and the lower forearm of the player. The cuff 103 is secured to the hand covering portion 102 of the glove 100 and has a proximal cuff edge 103A and a distal cuff edge 103B.

The hand covering portion 102 comprises four finger sheaths 104. Each finger sheath 104 includes a proximal finger sheath end 104A, a distal finger sheath end 104B, a medial finger sheath edge 104C and a lateral finger sheath edge 104D (see FIGS. 4 and 5). Each finger sheath 104 comprises a finger gusset 115 for enclosing a respective finger of the player as well as a finger protector 116 for protecting a respective finger from impact.

Figure 12:
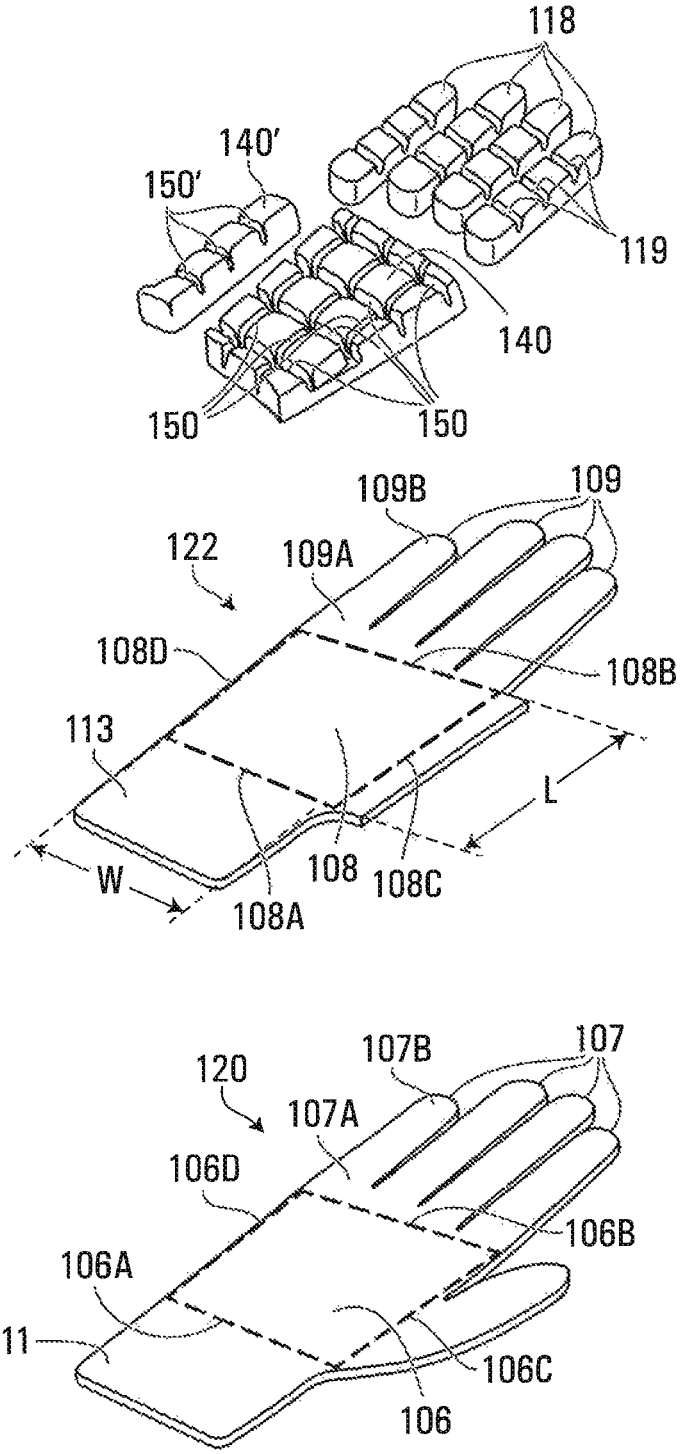
FIG. 12 is an exploded schematic view of a lower sheet, upper sheet, finger padding elements and dorsal padding elements of the glove of FIGS. 4 to 7.

As best shown in FIG. 12, the hand covering portion 102 also comprises a palm sheet 106 and a dorsal sheet 108 connected to a plurality of palm finger sheets 107 and dorsal finger sheets 109 respectively. In the embodiment shown, the palm and dorsal sheets 106, 108 are formed integral with their respective palm and dorsal finger sheets 107, 109 for defining lower and upper sheets 120, 122 for facing the palmar and dorsal regions of the player's hand of fingers and such lower and upper sheets 120, 122 may also have integrated proximal extensions 111, 113 for facing the lower and upper sides of the players' wrist and lower forearm. In other embodiments, the palm and dorsal sheets may be separate from (and attached to) the palm and dorsal finger sheets. The palm and dorsal sheets 106, 108 overly the metacarpal region MR of the human hand. As such, each of the palm and dorsal sheets 106, 108 respectively define proximal ends 106A, 108A, distal ends 106B, 108B, medial ends 106C, 108C and lateral ends 106D, 108D.

Figure 8:
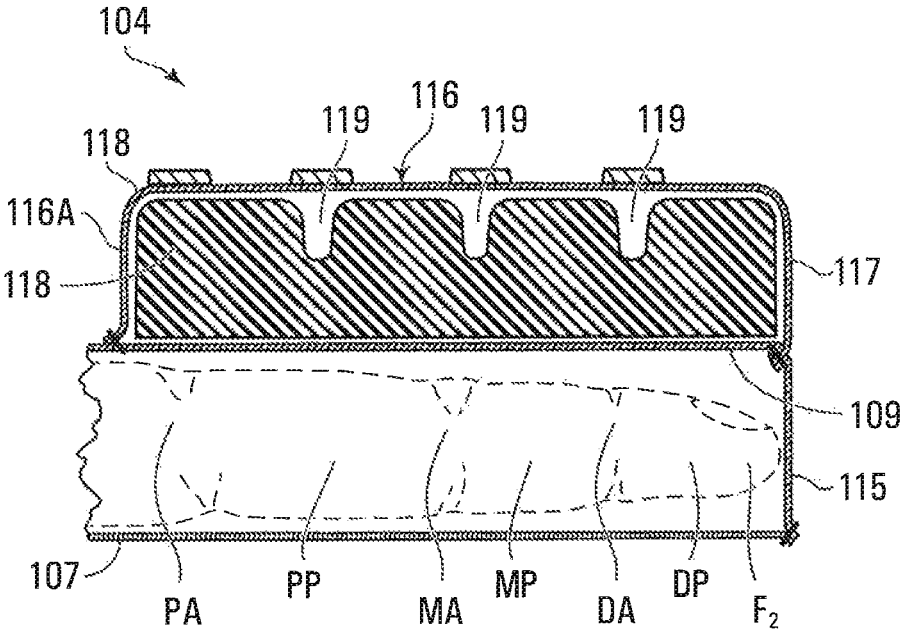
FIG. 8 is an enlarged cross-sectional view taken along lines 8-8 of FIG. 4 showing a finger in broken lines in its corresponding finger sheath.
Figure 9:
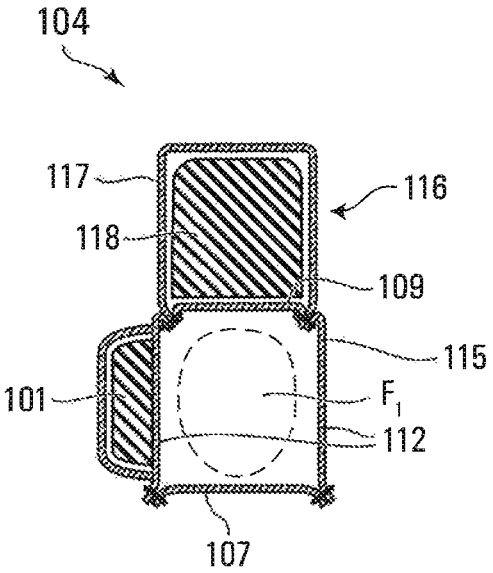
FIG. 9 is an enlarged cross-sectional view taken along lines 9-9 of FIG. 7 showing a finger in broken lines in its corresponding finger sheath.

As best shown in FIGS. 8 and 9, the respective palm and dorsal finger sheets 107, 109 are connected to each other via a side finger web 112 to create the finger gussets 115.

The four finger protectors 116 protect the dorsal surfaces of the index finger $F_1$, middle finger $F_2$, ring finger $F_3$ and little finger $F_4$ respectively. Each of the finger protectors 116 extends from a proximal end 116A to a distal end 116B and has a medial edge 116C and a lateral edge 116D. The proximal end 116A of each finger padding element 116 is positioned near the distal dorsal end 114B of the dorsal portion 114 and the distal end 116B of each finger padding element 116 is generally positioned near the respective distal phalanxes of the player's fingers. Each of the finger protectors 116 has a protective padding element 118 for protecting the fingers of a player's hand. This padding element 118 is contained in a pocket 117 that is affixed to one of the dorsal finger sheets 109.

Reverting to FIG. 12, the dorsal sheet 108 has a length L and a width W. The length L is measured along an axis generally parallel to a longitudinal axis A-A of the glove 100 and the width W is measured along an axis generally normal the longitudinal axis A-A of the glove 100. The longitudinal axis A-A of the glove 100 would be generally parallel to a longitudinal axis of the hand and wrist WR of the player. More specifically, the length L is measured between the proximal and distal ends 108A, 108B of the dorsal sheet 108 while the width W is measured between the medial and lateral ends 108C, 108D of the dorsal sheet 108. The dorsal sheet 108 will define a trapezoidal shape similar to the one defined by the metacarpal region MR (as shown in FIGS. 1A and 1C). Thus, while the dorsal sheet 108 is not perfectly rectangular, the dimensions of length L and width W are shown for illustrative purposes. Moreover, the trapezoid of the dorsal sheet 108 may be seen as defining a "maximal length" and a "maximal width". The expression "maximal length" refers to the largest dimension of the trapezoid when taken along the longitudinal axis A-A of the glove 100, while the term "maximal width" refers to the largest dimension of the trapezoid when taken along a direction generally perpendicular to the longitudinal axis A-A of the glove 100.

The lower and upper sheets 120, 122 may be made of a suitable flexible material such as soft leather, leather-like materials, synthetic suede, or Nash fabric. An example of a suitable material is commercialized under the name CLARINO™. The lower and upper sheets 120, 122 may also be treated with silicone to improve stick control and may further be reinforced with a protective layer.

The dorsal portion 114 of the glove 100 includes a padding element 140 enclosed in a single pocket 138 for forming a first dorsal protector 139 for overlying and protecting the dorsal side of the player's hand. The single pocket 138 is formed by stitching a layer of material to the dorsal sheet 108 via stitches 130 that at least partially surround the padding element 140. The dorsal protector 139 made of the single pocket 138 and padding element 140 overlies a substantial portion of the dorsal side of the player's hand when the player's hand is received in the hand covering portion 102 of the glove. As best shown in FIGS. 4, 5 and 12, the dorsal portion 114 of the glove 100 also includes a second dorsal protector 139' made of a second single pocket 138' enclosing a second padding element 140', the second dorsal protector 139' overlying the rest of the dorsal side of the player's hand. The padding element 140 has three longitudinal flexion zones 150 and four transversal flexion zones 150 while the padding element 140' has only three transversal flexion zones 150'.

The periphery of the dorsal portion 114 can include curved and/or straight profiles. In the embodiment shown, the proximal dorsal end 114A is delimited by a curved profile provided in the proximal end portions of the protectors 139, 139' while the lateral dorsal edge 114D has an inwardly bent profile defined by two substantially straight edges provided in the lateral side portion of the protector 139'. It is therefore understood that a variety of shapes delimiting the first and second dorsal protectors 139, 139' of the dorsal portion 114 may be contemplated by a skilled person in the art.

While the length L and width W of the dorsal portion 114 may vary from one embodiment to another, a glove in accordance with the present invention includes one dorsal protector made of a single pocket enclosing a padding element, the dorsal protector covering a substantial portion of the dorsal side of the player's hand. More specifically, the dorsal protector should occupy more than half of the length L of the dorsal sheet 108 and more than half of the width W of the dorsal sheet 108. In some embodiments, the dorsal protector may occupy at least three-quarters of the maximal length L of the dorsal sheet 108 and at least three-quarters of the maximal width W of the dorsal sheet 108. In the embodiment of FIGS. 4 and 5, the first dorsal protector 139 made of the single pocket 138 and padding element 140 occupies a majority of the maximal length L of the dorsal sheet 108 and a substantial part of the maximal width W of the dorsal sheet 108. Moreover, the padding element 140 contained in the single pocket 138 has at least one flexion zone 150 such that, in use, flexing of the player's hand imparts movement of the padding element 140 of the dorsal protector 139. In the embodiment, the padding element 140 has three longitudinal flexion zones 150 and four transversal flexion zones 150.

The glove 100 may also comprise overlay elements 160 mounted, affixed, molded, stitched or glued on an upper surface or layer of the single pocket 138 (or 138'). More specifically, a pattern of overlay elements 160 is provided on the dorsal portion 114 of the glove 100. In the embodiment shown, the overlay elements 160 generally have an elongated shape. Overlay elements 160 may be made of any material that may provide an additional level of protection to the dorsal side of a player's hand thereby acting as reinforcement elements. For example, overlay elements 160 may be made of plastic such as polyvinyl chloride (PVC), polyethylene terephtalate (PET), etc. Furthermore, overlay elements 160 may be attached to the pocket 138 via any appropriate means such as by fusing the plastic to the fabric, sewing, via an adhesive, etc.

In some embodiments, a majority of the single pockets 138, 138' may be covered with the overlay elements 160. Other patterns and shapes can however be envisioned by a person of skill in the art to provide a desired level of reinforcement and/or a desired visual appearance to the glove 100.

Thus, the overlay elements 160 can provide an inexpensive option to enhance the level of protection provided by the glove 100. Furthermore, the overlay elements 160 can also give the glove 100 a decorative and more detailed visual appearance, thereby mimicking the appearance of a glove having a plurality of different and distinct dorsal protectors separated by a plurality of gaps, spaces, grooves, channels or flexion zones. It is understood that the overlay elements 160 may be primarily aesthetic while providing little additional protection.

Figure 15:
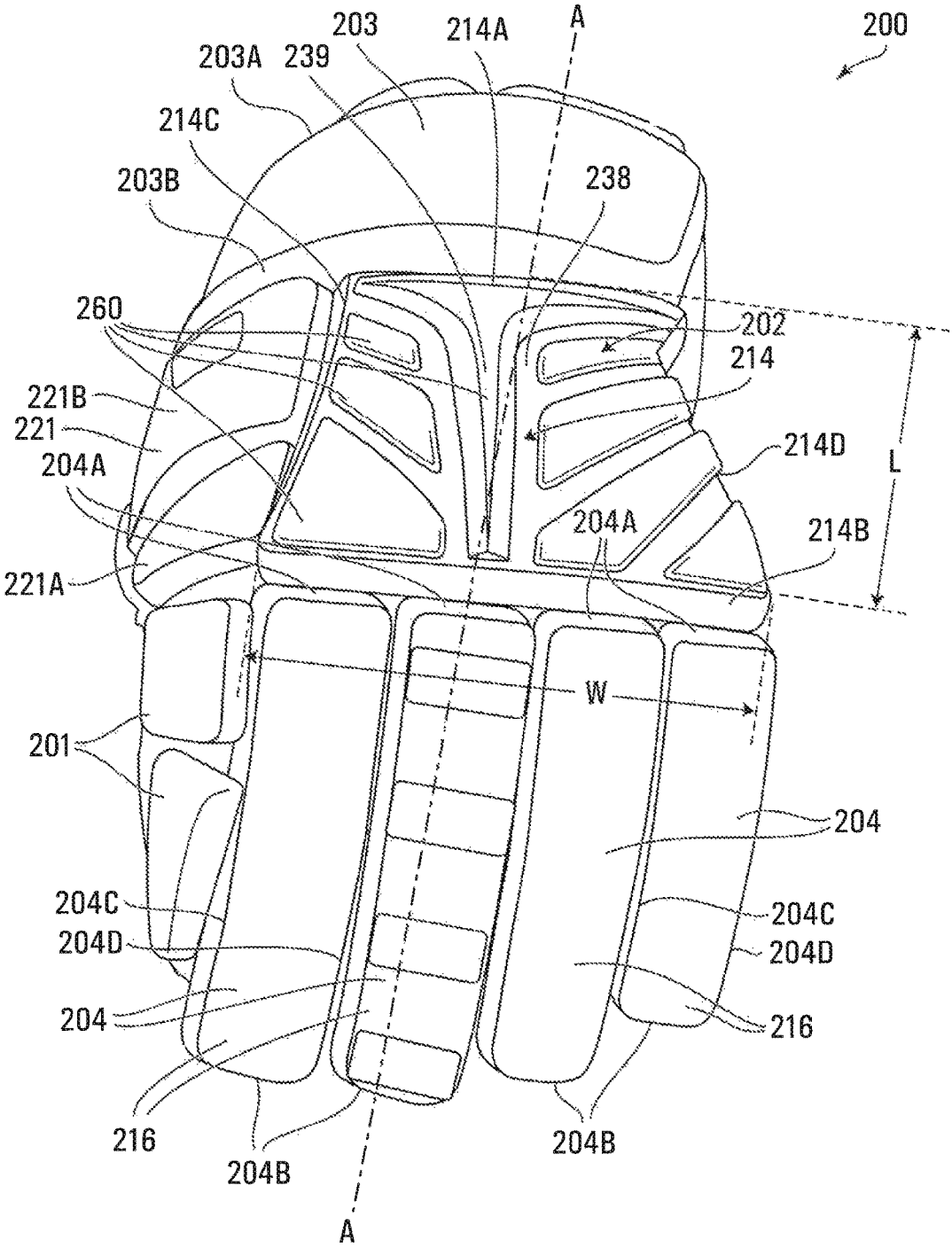
FIG. 15 is a perspective view of a hockey glove constructed in accordance with a second embodiment of the invention.

Other embodiments, such as glove 200 shown in FIG. 15, are also possible (it is noted that elements of glove 200 which are similar to those of glove 100 are designated by similar reference numerals in the 200 series). In this embodiment, the glove 200 includes a dorsal protector 239 made of a single pocket 238 enclosing a padding element 240, the dorsal protector 239 occupying substantially all of the maximal length L and width W of the dorsal sheet. In other words, the single pocket 238 and padding element 240 contained therein form the single dorsal protector 239, which is the sole protector of the dorsal portion 214, thereby protecting all of the dorsal side of the player's hand.

With specific reference to FIGS. 13, 14, 16 and 17, different embodiments of the dorsal padding elements will now be described in more detail.

Figure 13:
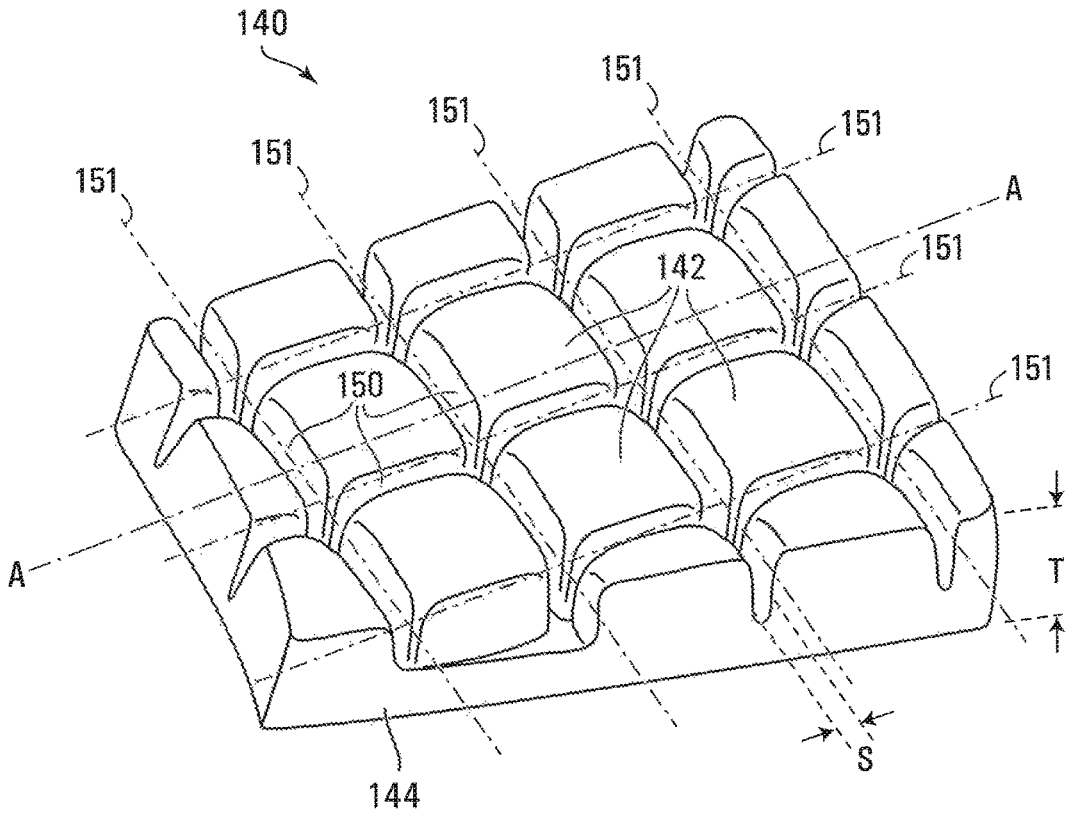
FIGS. 13 and 14 are perspective views of dorsal padding elements in accordance with first and second embodiments for the glove of FIGS. 4 to 7.
Figure 14:
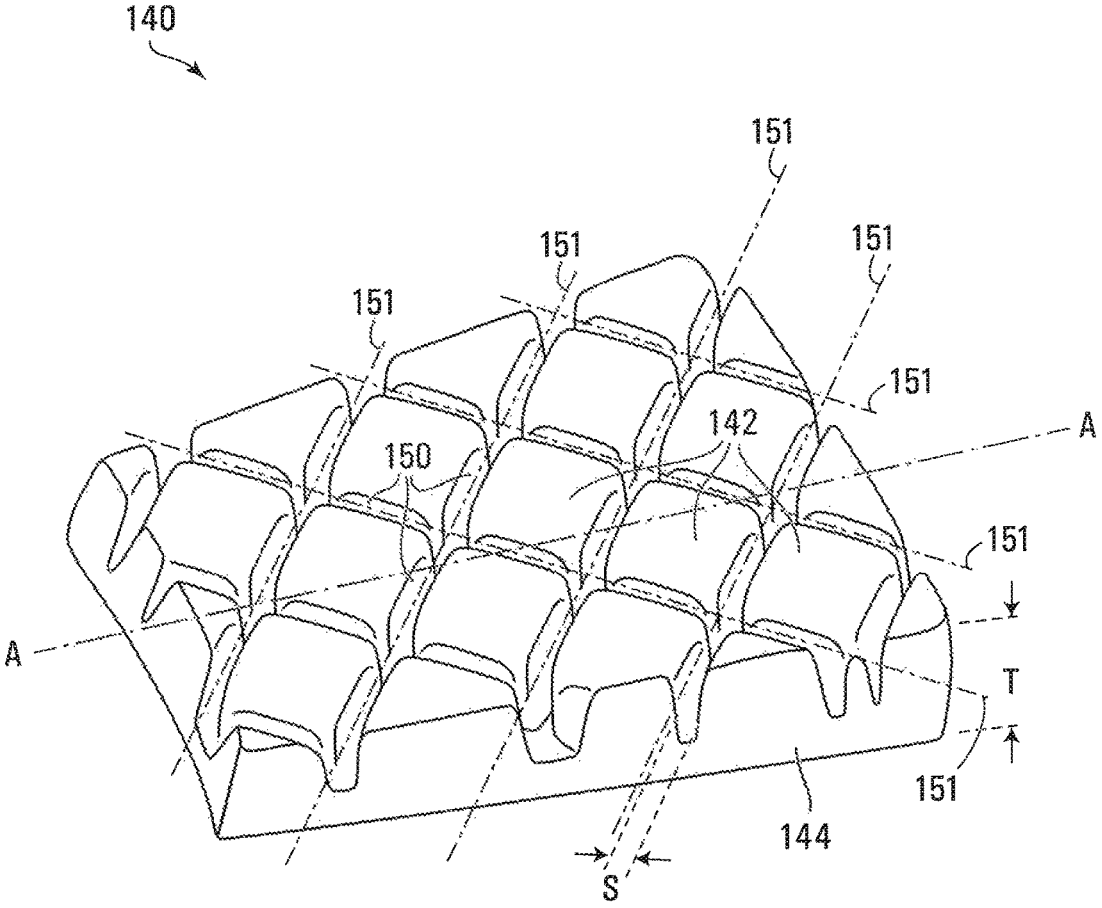
Figure 16:
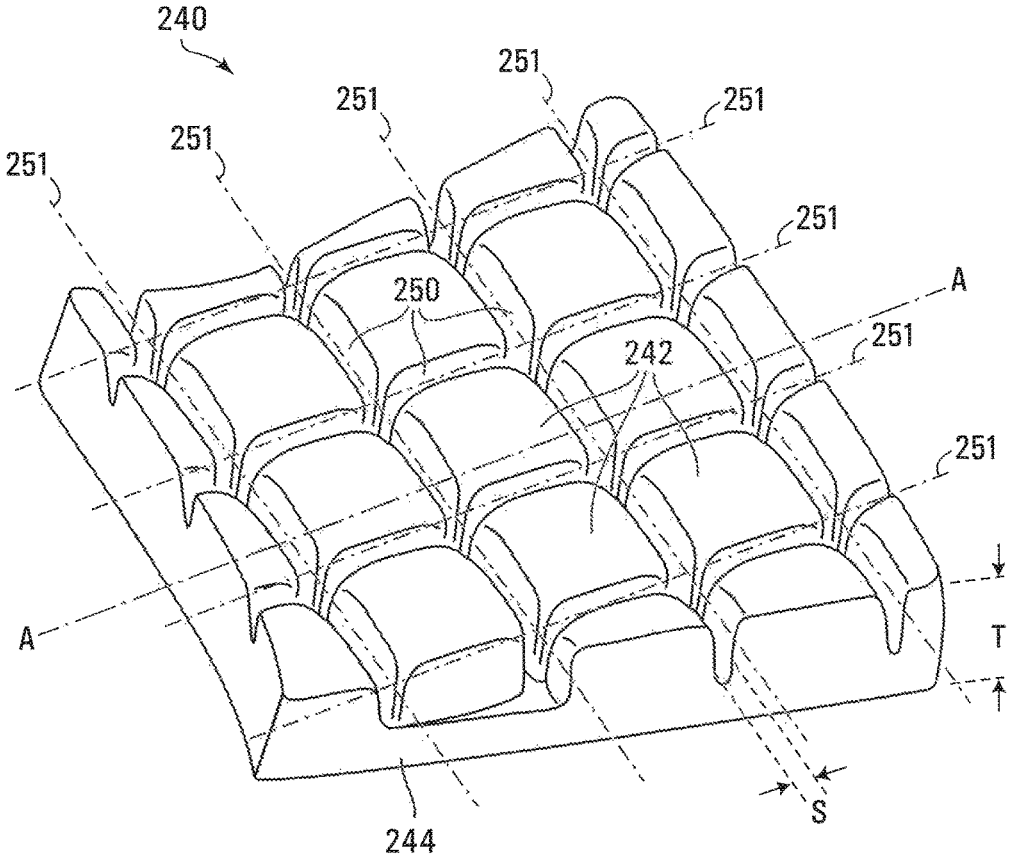
FIGS. 16 and 17 are perspective views of dorsal padding elements in accordance with first and second embodiments for the glove of FIG. 15.
Figure 17:
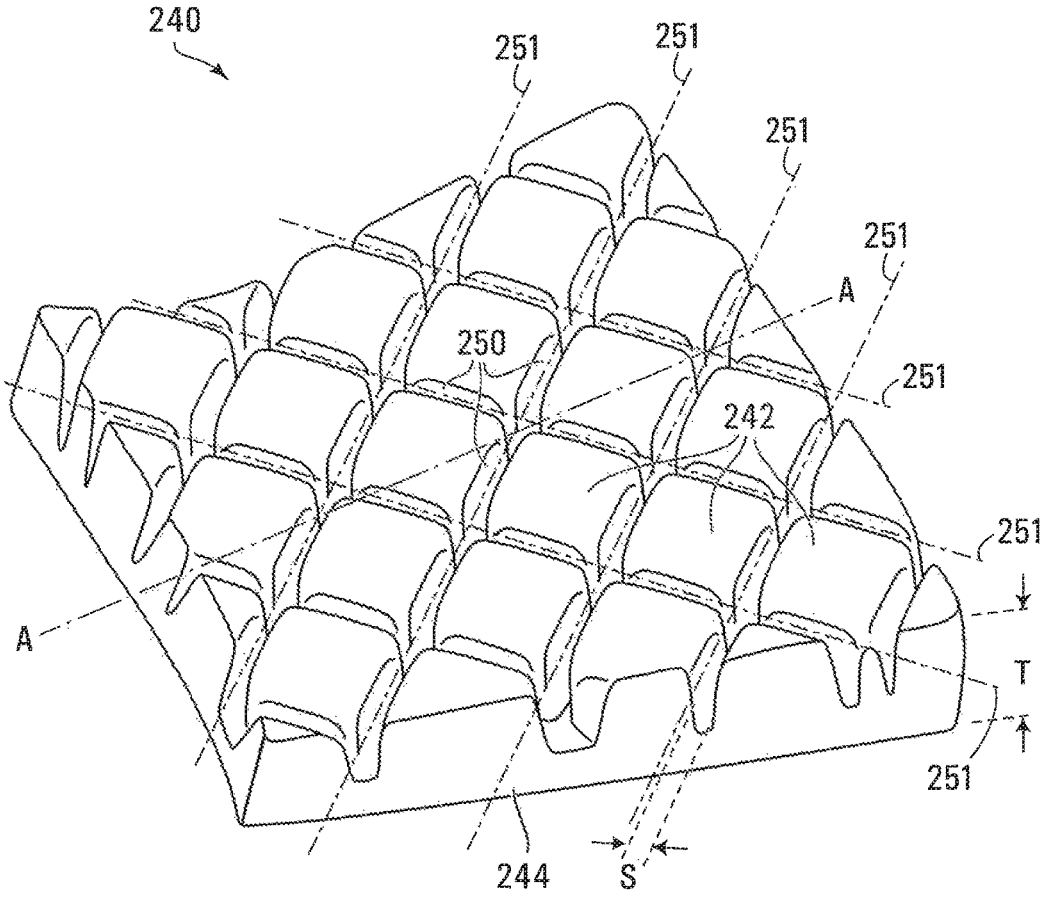

FIGS. 13 and 14 show two different examples of a padding element 140 which would be used in the glove 100 and FIGS. 16 and 17 show two different examples of a padding element 240 which would be used in the glove 200.

The respective padding elements 140, 240 include a plurality of substantially rectangular padding blocks 142, 242, base portions 144, 244 and flexion zones 150, 250 positioned between the rectangular padding blocks 142, 242 to accommodate flexing of the player's hand by easing the flexing of the glove in the dorsal portions 114, 214. In the embodiment shown, the flexion zones 150, 250 are shaped such that they generally extend along flexion axes 151, 251. Flexion axes 151, 251 are arranged in a checkerboard pattern in FIGS. 13 and 16 such as to permit a generally even amount of flexion in both the lengthwise and widthwise direction of the padding elements 140, 240. More specifically, some of the flexion axes 151, 251 are generally perpendicular to the longitudinal axis A-A of the glove while others are generally parallel to the longitudinal axis A-A of the glove. The flexion axes 151, 251 can however be arranged in any other desired patterns. For example, in the embodiments of FIGS. 14 and 17, the flexion axes 151, 251 extend in a direction generally transverse to the longitudinal axis A-A of the glove, without being parallel or perpendicular thereto. In yet other embodiments, the flexion zones 150, 250 may extend along straight, curved, wavy or zigzag lines separating padding blocks of any shape. In addition, some embodiments may include a padding element having a single flexion zone across a portion or the entirety of the padding element. Furthermore, it should be noted that a given flexion zone needs not to extend throughout all the thickness of the padding element.

The padding elements 140, 240 may be thermoformed in order to produce the plurality of rectangular blocks 142, 242 and flexion zones 150, 250. A variety of different types of foam may be used for the padding elements 140, 240. For example, the padding elements 140, 240 may be made of polyether foam, polyester foam, ethafoam, volara, etc.

Furthermore, the padding elements 140, 240 may each have a thickness T of approximately 1.75 to 2.0 cm while the flexion zones 150, 250 may define channels, grooves, gaps or spaces S of approximately 1.0 to 1.5 mm between the rectangular blocks 142, 242 and may have a thickness of approximately 5% to 95% of the thickness T of the padding element.

In other embodiments, the thickness T and spaces S of the padding elements 140, 240 could be of different dimensions in order to modify the amount of flexion and protection provided by the padding elements 140, 240. For example, the padding elements 140, 240 may have a thickness of 1.5 cm and spaces of 2 mm in order to further ease flexion of the dorsal side of the player's hand. Other combinations are possible in order to optimize the desired level of flexion and protection for a given glove.

Furthermore, depending on the inherent flexibility of the type of padding material used, the padding element may have only one flexion zone. In addition, other physical characteristics of the padding elements 140, 240 may be selected to satisfy a specific purpose. For example, the padding element may be slightly curved in order to wrap around the player's hand. The curvature may be along the lengthwise and/or widthwise directions of the glove.

The padding elements 140, 240 may be cut from a sheet of padding material having a plurality of padding blocks or projections separated by flexing zones in order to produce a shape which is tailored to the dimensions of the dorsal protectors 139, 139' of the gloves 100 and dorsal protector 239 of the glove 200. Thus, a single uniform sheet of padding material may be manufactured and used to form padding elements 140, 240 for a plurality of gloves. As there are a virtually unlimited number of cutting lines along which the padding material may be cut, the shape of the padding elements 140, 240 may be easily shaped to accommodate the requirements of a specific glove. Moreover, the padding material may be cut to accommodate a plurality of gloves having a variety of designs and sizes.

While the padding elements 140, 240 have been shown as a single piece held within respective single pockets 138, 138', 238, it is understood that each of the padding elements 140, 240 can refer to a plurality of pieces contained within the respective single pockets 138, 138', 238. In such embodiments, the manufacturing of flexion zones 150, 250 may be omitted and a predefined amount of spacing may be provided between the individual pieces of the dorsal padding elements in order to create an effect similar to that of spaces S of the dorsal padding elements 140, 240. In such embodiments, it is understood that a single pocket 138, 138', 238 would contain the plurality of individual pieces of the dorsal padding elements.

Thus, while prior art gloves (such as glove 10) rely on the presence of a plurality of gaps, spaces, grooves, channels or flexing zones between a plurality of dorsal protectors, a glove in accordance with the present invention provides such flexibility with a simpler arrangement. More specifically, a substantial portion or the entirety of the dorsal side of a player's hand is protected with a dorsal protector made of a single pocket enclosing a padding element while still permitting flexion of the player's hand via one or more gaps, spaces, grooves, channels or flexion zones provided in the padding element or between individual pieces of the padding element.

Figure 10:
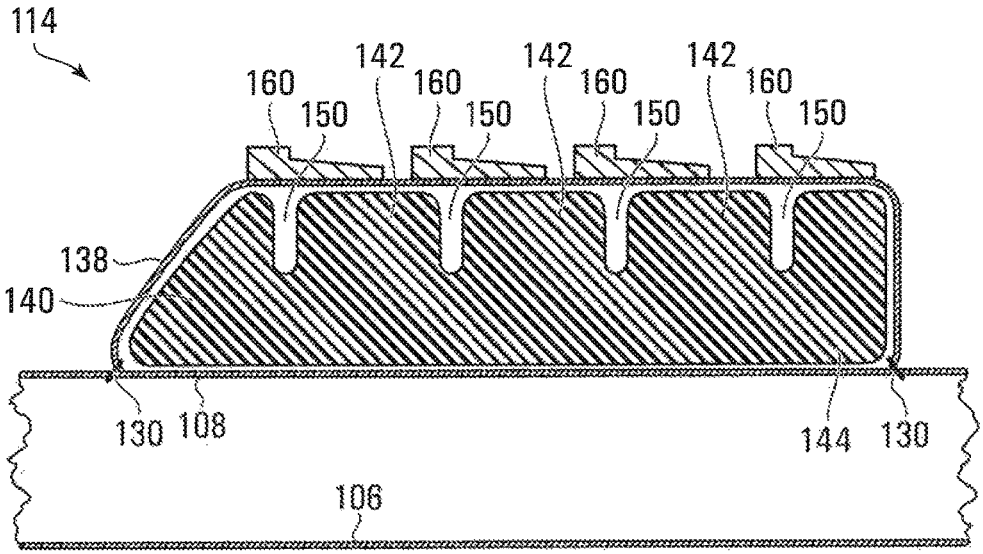
FIG. 10 is an enlarged cross-sectional view taken along lines 10-10 of FIG. 5 in accordance with a first embodiment of the present invention.
Figure 11:
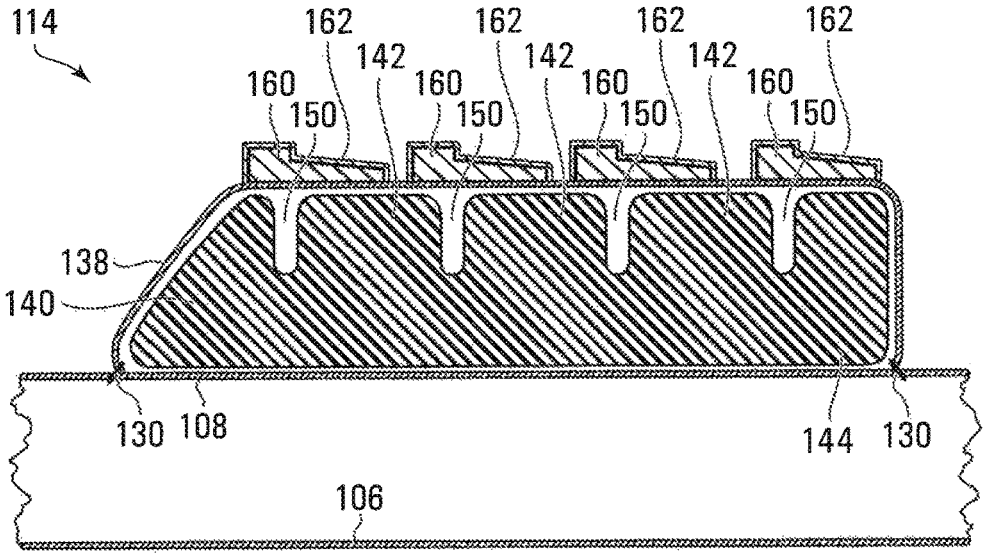
FIG. 11 is an enlarged cross-sectional view taken along lines 10-10 of FIG. 5 in accordance with a second embodiment of the present invention.

With specific reference to FIGS. 10 and 11, two different embodiments are shown regarding the overlay elements 160.

In FIG. 10, the overlay elements 160 are affixed to the upper surface or layer of the pocket 138 via any suitable means such as an adhesive, fusion, sewing, etc. and the outer surface of each overlay element 160 is directly exposed.

In the embodiment of FIG. 11, the overlay elements 160 are contained between the single pocket 138 and a covering layer 162 that is attached to the upper surface or layer of the pocket 138. The overlay elements 160 may be attached to either of the single pocket 138 and covering layer 162. Alternatively, the overlay elements 160 can simply lie between the single pocket 138 and covering layer 162.

In both embodiments, namely the one where the overlay elements 160 are directly exposed and the one where the overlay elements are covered by the covering layers 162, the overlay elements 160 form bumps projecting upwardly from the upper surface or layer of the pocket 138 (138' or 238) for creating a decorative pattern on the dorsal portion 114 (or 214) of the glove. The overlay elements 160 or covering layers 162 may be contrastingly colored in comparison to the rest of the dorsal portion 114 (or 214) to emphasize the presence of the overlay elements 160 or simply for aesthetic value.

As indicated previously, the overlay elements 160 may provide further protection or may be purely aesthetic for adding decorative value. The overlay elements 160 and covering layers 162 may be patches of additional fabric of different color affixed to the pocket 138 (138' or 238) and/or thermoformed material fused to the pocket 138 (138' or 238).

Any feature of any embodiment discussed herein may be combined with any feature of any other embodiment discussed herein in some examples of implementation. Various embodiments and examples have been presented for the purpose of describing, but not limiting, the invention. Various modifications and enhancements will become apparent to those of ordinary skill in the art and are within the scope of the invention, which is defined by the appended claims.

The invention claimed is:

1. A hockey or lacrosse glove for protecting a hand of a hockey or lacrosse player, the hockey or lacrosse glove defining a longitudinal axis configured to be parallel to a longitudinal axis of the player's hand and comprising a hand receiving portion and a cuff that is configured to at least partially cover a wrist of the player, the cuff extending longitudinally from a proximal end to a distal end, the hand receiving portion comprising:

(a) a thumb sheath configured to protect a thumb of the player's hand;

(b) four finger sheaths configured to protect four fingers of the player's hand, each finger sheath having a finger gusset configured to receive the finger and a finger protector covering the finger gusset, each finger gusset having a proximal end configured to cover a proximal articulation of the finger and a distal end configured to cover a distal end of the finger;

(c) a palm sheet configured to cover a palm of the player's hand;

(d) a dorsal sheet configured to cover a dorsal side of the player's hand, the dorsal sheet extending longitudinally from a proximal end proximate the distal end of the cuff to a distal end proximate the proximal end of each finger gusset and configured to extend transversally from a medial end proximate a medial edge of the dorsal side of the player's hand to a lateral end proximate a lateral edge of the dorsal side of the player's hand, the dorsal sheet having a maximal length measured between its proximal and distal ends and a maximal width measured between its medial and lateral ends; and (e) a dorsal protector covering the dorsal sheet, the dorsal protector comprising (i) a single pocket mounted to the dorsal sheet and occupying at least three-quarters of the maximal length of the dorsal sheet and at least three-quarters of the maximal width of the dorsal sheet and (ii) a padding element contained in the single pocket, the padding element comprising an arrangement of padding blocks and a flexion zone such that, in use, the padding element is configured to flex in response to flexing of the player's hand, a material of the padding element being composed of a single material that is continuous across the flexion zone, and a thickness of said material of the padding element within the flexion zone being different from a thickness of said material of the padding element outside of the flexion zone.

2. The hockey or lacrosse glove of claim 1, wherein the single pocket and padding element of the dorsal protector occupy substantially all of the maximal length of the dorsal sheet.

3. The hockey or lacrosse glove of claim 1, wherein the single pocket and padding element of the dorsal protector occupy substantially all of the maximal width of the dorsal sheet.

4. The hockey or lacrosse glove of claim 1, wherein the flexion zone is defined by at least one gap, space, groove or channel provided in the padding element.

5. The hockey or lacrosse glove of claim 4, wherein the at least one gap, space, groove or channel extends in a direction generally parallel to the longitudinal axis of the hockey or lacrosse glove.

6. The hockey or lacrosse glove of claim 4, wherein the at least one gap, space, groove or channel extends in a direction generally transverse to the longitudinal axis of the hockey or lacrosse glove.

7. The hockey or lacrosse glove of claim 4, wherein the at least one gap, space, groove or channel has a straight, curved, wavy or zigzag shape.

8. The hockey or lacrosse glove of claim 1, wherein the flexion zone includes a plurality of gaps, spaces, grooves or channels intersecting one another.

9. The hockey or lacrosse glove of claim 1, wherein the material of the padding element is foam.

10. The hockey or lacrosse glove of claim 1, further comprising at least one overlay element provided on the single pocket.

11. The hockey or lacrosse glove of claim 10, wherein the at least one overlay element is adhesively affixed to the single pocket.

12. The hockey or lacrosse glove of claim 10, wherein the at least one overlay element is fused to the single pocket.

13. The hockey or lacrosse glove of claim 10, wherein the single pocket forms a first upper layer, and wherein the dorsal protector further comprises a second upper layer affixed to the first upper layer, and wherein the at least one overlay element is contained between the first and second upper layers.

14. The hockey or lacrosse glove of claim 10, wherein the at least one overlay element is made of plastic.

15. The hockey or lacrosse glove of claim 1, wherein the dorsal protector, single pocket, padding element and flexion zone are a first dorsal protector, a first single pocket, a first padding element and a first flexion zone respectively and wherein the glove further comprises a second dorsal protector covering the dorsal sheet, the second dorsal protector comprising (i) a second single pocket mounted to the dorsal sheet and occupying less than one-quarter of the maximal length of the dorsal sheet and less than one-quarter of the maximal width of the dorsal sheet and (ii) a second padding element contained in the second single pocket, the second padding element comprising a second flexion zone such that, in use, the padding element is configured to flex in response to flexing of the player's hand, a material of the second padding element being continuous across the flexion zone, and a thickness of said material of the second padding element within the second flexion zone being different from a thickness of said material of the padding element outside of the flexion zone.

16. The hockey or lacrosse glove of claim 15, wherein the second flexion zone is defined by at least one second gap, space, groove or channel.

17. The hockey or lacrosse glove of claim 16, wherein the at least one second gap, space, groove or channel extends in a direction generally parallel to the longitudinal axis of the hockey or lacrosse glove.

18. The hockey or lacrosse glove of claim 16, wherein the at least one second gap, space, groove or channel extends in a direction generally transverse to the longitudinal axis of the hockey or lacrosse glove.

19. A hockey or lacrosse glove extending in a longitudinal direction and comprising a hand receiving portion with a dorsal protector, the dorsal protector comprising:

a single pocket occupying at least three-quarters of a maximum dimension of the hand receiving portion along the longitudinal direction of the glove and occupying at least three-quarters of a maximum dimension of the hand receiving portion along a second direction that is transverse to the longitudinal direction; and a padding element contained in the single pocket, the padding element being made of a flexible material that is composed of a single material, the padding element comprising an arrangement of padding blocks and a flexion zone such that, in use, the padding element is configured to flex in response to flexing of a hand received in the hand receiving portion, a thickness of said flexible material of the padding element across the flexion zone being different from a thickness of said flexible material of the padding element outside of the flexion zone.

20. The hockey or lacrosse glove defined in claim 19, wherein the single pocket is configured for overlying substantially all of a dorsal side of the hand received in the hand receiving portion.

21. The hockey or lacrosse glove of claim 8, wherein each of the gaps, spaces, grooves or channels extends along a respective axis, the axis of each of a first subset of the gaps, spaces, grooves or channels intersecting the axis of each of a second subset of the gaps, spaces, grooves or channels.

22. A hockey or lacrosse glove comprising:

(a) a plurality of finger sheaths configured to receive fingers of a hand of a user;

(b) a dorsal sheet configured to cover a dorsal side of the hand;

(c) a dorsal protector covering the dorsal sheet, the dorsal protector comprising (i) a single pocket mounted to the dorsal sheet and (ii) a padding element contained in the single pocket, the padding element being made of a flexible material that is composed of a single material, the flexible material of the padding element providing continuous padding across the dorsal protector in a widthwise direction and a lengthwise direction of the dorsal protector, the padding element comprising an arrangement of padding blocks and a flexion zone disposed between the padding blocks such that, in use, the padding element is configured to flex in response to flexing of the hand, a thickness of the flexible material of the padding element across the flexion zone being different from a thickness of said flexible material of the padding element outside of the flexion zone.

23. The hockey or lacrosse glove of claim 19, wherein the thickness of the flexible material of the padding element within the flexion zone is between 5% and 95% of the thickness of said flexible material of the padding element outside of the flexion zone.

24. The hockey or lacrosse glove of claim 23, wherein the thickness of the flexible material of the padding element is between 1.75 to 2.0 cm outside of the flexion zone.

* * * * *